United States Patent [19]

Bailey

[11] Patent Number: 4,847,562

[45] Date of Patent: Jul. 11, 1989

[54] IGNITION COIL PRIMARY WINDING SIGNAL PROCESSING SYSTEM

[75] Inventor: Bill E. Bailey, Kent, Wash.

[73] Assignee: Pacific Northwest Electronics, Seattle, Wash.

[21] Appl. No.: 96,126

[22] Filed: Sep. 11, 1987

[51] Int. Cl.[4] ..... F02P 17/00

[52] U.S. Cl. ..... 324/379; 324/384

[58] Field of Search ..... 324/169, 379, 380, 384, 324/385, 386, 392; 307/561, 565

[56] References Cited

U.S. PATENT DOCUMENTS

| | | | |
|---|---|---|---|
| 3,650,149 | 3/1972 | Howes | 324/384 |
| 3,731,206 | 5/1973 | Veale | 307/561 |
| 3,870,947 | 3/1975 | Fields | 324/16 R |
| 3,955,135 | 5/1976 | Fastaia | 324/16 R |
| 3,961,239 | 6/1976 | Lach | 324/15 |
| 3,986,009 | 10/1976 | Fastaia | 235/151.3 |
| 4,074,183 | 2/1978 | Voross | 324/16 R |
| 4,109,195 | 8/1978 | Palmer | 324/15 |
| 4,249,130 | 2/1981 | Goss | 324/386 |
| 4,251,774 | 2/1981 | Knodler | 324/384 |
| 4,379,263 | 4/1983 | Everett et al. | 324/394 |

OTHER PUBLICATIONS

Mohammed S. Ghausi; "*Electronic Circuits*", D. Van Nostrand Co., Copyright 1971, p. 465.

*Primary Examiner*—Reinhard J. Eisenzopf
*Assistant Examiner*—Anthony L. Miele
*Attorney, Agent, or Firm*—Christensen, O'Connor, Johnson & Kindness

[57] ABSTRACT

An ignition coil primary winding signal processing system that is suitable for use with cathode ray tube based instruments used in the troubleshooting, diagnosing, and servicing of spark ignition internal combustion engines. A primary trigger signal gnerator (4) processes the waveform obtained from the primary winding of the ignition coil of an internal combustion engine, $V_S$, and produces a logical signal, $V_L$, which drives a bistable circuit. The bistable circuit includes a D flip-flop FF1 that produces a square wave trigger signal, $V_T$, whose rising edge corresponds to the point in time of the ignition points break, or the equivalent occurs in an electronic or transistorized ignition system. A dwell angle-to-voltage converter (8) also processes the complex waveform obtained from the ignition coil primary winding of an internal combustion engine, $V_S$, and produces a nonfluctuating waveform, $V_{C4}$, that is compared to a reference voltage. The comparator, OA-2, produces an inverted rectangular waveform $V_R$. A second D flip-flop FF2, also forming a part of the bistable circuit, is set by $V_R$. The output of FF2 resets FF1 after a delay introduced by a delay circuit (6). $V_R$, which containes dwell angle information in the time domain, is also processed by a buffer B1 and an averaging network (9), which connects the dwell angle information into a voltage domain dwell angle signal, $V_{DA}$.

21 Claims, 3 Drawing Sheets

IGNITION COIL PRIMARY WINDING SIGNAL PROCESSING SYSTEM

TECHNICAL AREA

This invention relates to signal processors and, more particularly, to processors of signals produced by the ignition coil of a spark ignition internal combustion engine.

BACKGROUND OF THE INVENTION

The use of cathode ray tube based instruments, such as oscilloscopes, to analyze internal combustion engine performance, has become prevalent in recent years. The increased use of these instruments is, in part, due to the increasing complexity of the electronic portion of internal combustion engines and, in part, due to the increasing technical capabilities of the persons analyzing such engines. The various uses of oscilloscopes to analyze internal combustion engines covers a broad spectrum, including measuring the electrical and mechanical timing of the engine, such as the coincidence of spark discharge to cylinder valve operation, and measuring the many electrical signals present in the controlling and monitoring systems of a modern internal combustion engine.

It is usually necessary to synchronize the trigger sweep of an oscilloscope to the test device being monitored in order for a meaningful oscilloscope display to be created. When the test device is an internal combustion engine, the synchronization between the oscilloscope and the engine under test may be obtained from different locations, depending upon the type of analysis to be performed. In some instances the synchronization signal is obtained from a reference cylinder spark plug wire. In other instances the synchronization signal is obtained from the primary winding of the ignition coil. The present invention involves processing the latter source of synchronization signals.

Unfortunately, primary winding derived synchronizing signals are noisy because the point opening and closing that causes spark discharge is not abrupt and precise. Furthermore, the inductive capacitive nature of the coil and condenser combination create complex signals. Contrariwise, in order to be useful, trigger pulses should have only one rising edge per cycle of ignition point opening and closing. Further, the rising edge should occur with minimal delay from the point in time when the ignition points break. While solid state, e.g., transistorized, ignition systems do not use points, such ignition systems also create complex signals at the primary winding of an ignition coil and thus, present the same problems. Because the spark discharge signals detected by a synchronizing test lead are complex and, thus, are unsuitable for triggering an oscilloscope in the form generated, it is necessary to process these signals. This invention is directed to such a processor. More specifically, this invention is directed to providing an ignition coil primary winding signal processing system that provides oscilloscope trigger pulses having only one rising edge per spark plug firing cycle. Further, the trigger pulses occur with minimal delay from the start of such a cycle, i.e., from the time ignition points break in the case of a breaker plate ignition system or the time a semiconductor switch opens in an electronic (e.g., transistorized) ignition system.

Ignition coil primary winding signals are normally used to measure the dwell angle or ignition duty cycle of an internal combustion engine. In the case of a breaker plate ignition system the dwell angle is the ratio of the measure of the time that the ignition points are closed to the measure of the time of one full open and close ignition point cycle. An equivalent ratio is produced by electronic ignition systems. The present invention is also directed to providing an ignition coil primary winding signal processing system that produces a voltage representative of the dwell angle of an internal combustion engine that includes either a breaker plate or an electronic ignition system.

SUMMARY OF THE INVENTION

In accordance with this invention, an ignition coil primary winding signal processing system is provided that is ideally suited for use with cathode ray tube based instruments used in the troubleshooting, diagnosing, and servicing of spark ignition internal combustion engines. The ignition coil primary winding signal processing system includes a primary trigger signal generator that produces a trigger signal whose rising edge corresponds to the point and time that the ignition points break, or the equivalent occurs in an electronic or transistorized ignition system. The trigger signal is suitable for use in synchronizing the display of a cathode ray tube based instrument, such as an oscilloscope, with the operation of the spark ignition internal combustion engine that produced the trigger signal. The ignition coil primary winding signal processing system also includes a dwell angle-to-voltage converter that generates a voltage proportional to the ratio of the times that the ignition points of a breaker plate based internal combustion engine are closed to the time of one opening and closing cycle of the ignition points, or the equivalent ratio of an electronic or transistorized ignition system based internal combustion engine. The proportional voltage signal is suitable for conversion to a numeric readout in either degrees dwell or percent duty cycle.

In accordance with other aspects of this invention, the primary trigger signal generator includes a signal conditioning circuit that receives the complex waveform signal created at the primary winding of a spark ignition internal combustion engine that is initiated just prior to a spark plug being fired and produces: (i) a clipped version of the complex waveform signal; and (ii) a reference voltage signal that is proportional to the system voltage of the internal combustion engine that produced the complex waveform signal. The primary trigger signal generator also includes a comparator for comparing the clipped version of the complex waveform signal with the reference signal and produces a logical output that shifts states as the clipped version of the complex waveform signal swings back and forth. Thus, the first transition of the output of the comparator corresponds to the time when the ignition points break or the equivalent action occurs in an electronic ignition system. The primary trigger signal generator also includes a multivibrator circuit connected to the output of the comparator that shifts states to produce a trigger signal in response to the first transition of the output of the comparator and remains in the shifted state until reset at a later point in an ignition cycle.

In accordance with still further aspects of this invention, the dwell angle-to-voltage converter also receives the complex waveform signal created at the primary winding of the ignition cell of a spark ignition internal combustion engine.

BRIEF DESCRIPTION OF THE DRAWINGS

The foregoing and other features and advantages of this invention will become more readily appreciated as the same becomes better understood by reference to the following detailed description when taken in conjunction with the accompanying drawings wherein.

DETAILED DESCRIPTION OF THE PREFERRED EMBODIMENT

Figure 1:
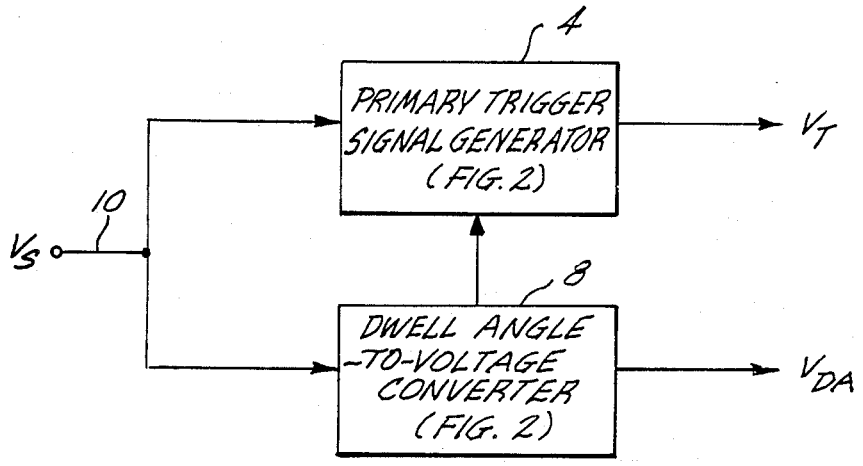
FIG. 1 is a block diagram of an ignition coil primary winding signal processing system formed in accordance with this invention.

As illustrated in FIG. 1, the preferred embodiment of an ignition coil primary winding signal processing system formed in accordance with the present invention comprises a primary signal generator 4 and a dwell angle voltage converter 8. Both the primary trigger signal generator 4 and the dwell angle voltage converter 8 are connected to the primary winding of the ignition coil of an internal combustion engine to be tested by an instrument that incorporates the invention (i.e., an oscilloscope) by a test lead 10. Thus, both the primary trigger signal generator 4 and the dwell angle-to-voltage converter 8 receive a complex waveform signal, denoted $V_S$ (FIG. 3, line A), whose shape is controlled by the opening and closing of the points in a breaker plate ignition system or a solid state switch in an electronic ignition system. As will be better understood from the following description of the primary trigger signal generator 4 illustrated in FIG. 2, the primary trigger signal generator 4 processes the complex waveform signal, $V_S$, and produces a squarewave signal, designated $V_T$ (FIG. 3, line J), having a single rising edge per ignition point or solid state switch open and close cycle. Further, the single rising edge occurs with a minimal delay from the point in time the ignition points break or the solid state switch opens. As will be better understood from the following description of the dwell angle voltage converter 8 illustrated in FIG. 2, the dwell angle voltage converter 8 produces an output signal, designated $V_{DA}$, whose voltage magnitude is representative of the ignition point dwell angle (or duty cycle), or the equivalent in an electronic ignition system. More specifically, $V_{DA}$ is proportional to the measure of time that the ignition points (or a solid state switch) are closed to the measure of time of one full ignition point (or solid state switch) open and close cycle.

Figure 2:
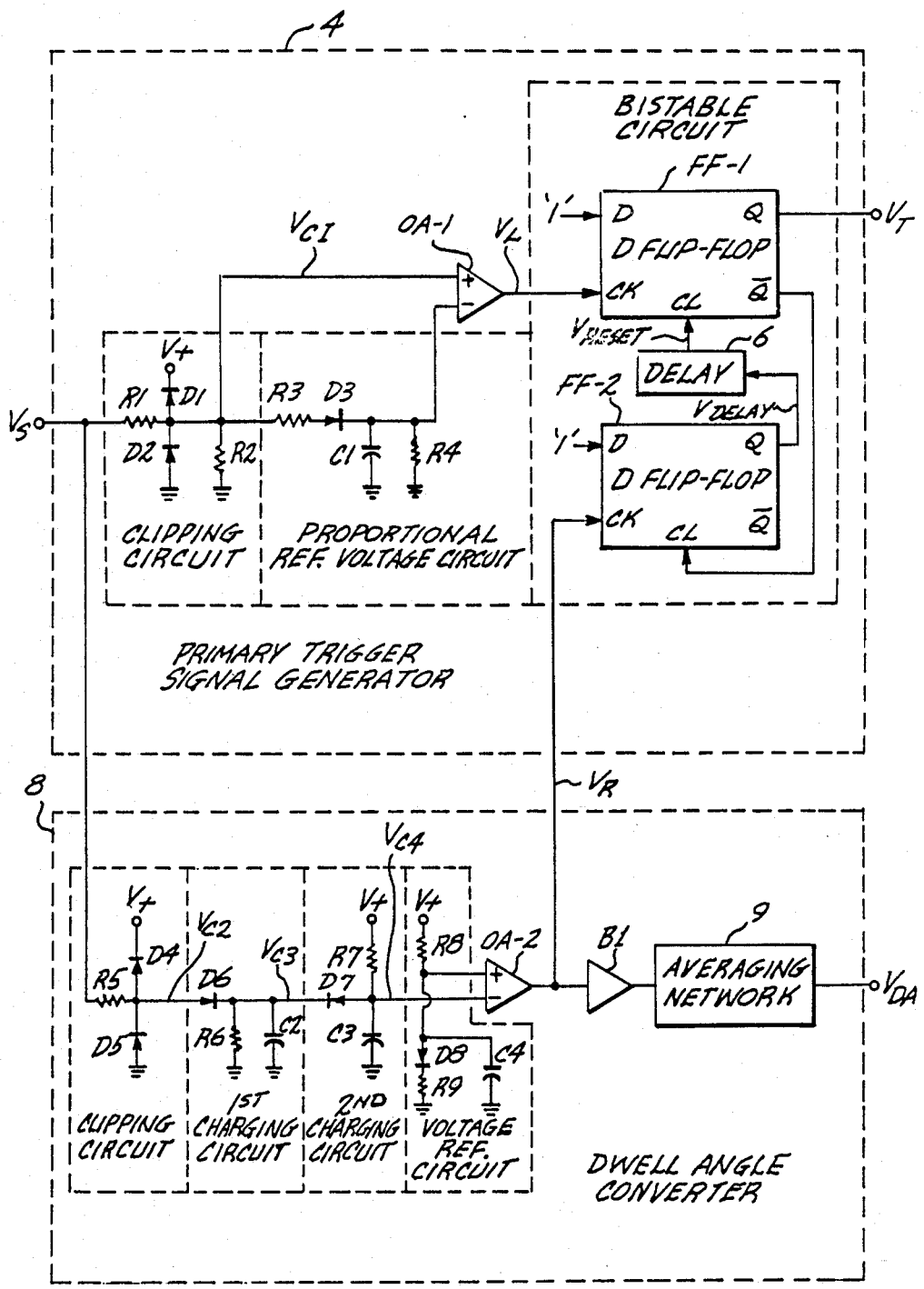
FIG. 2 is a schematic diagram of a primary trigger signal generator and a dwell angle-to-voltage converter suitable for use in the embodiment of the invention illustrated in FIG. 1; and, FIG. 3 is a series of waveforms illustrating the shapes of signals at various designated points (A–J) of the primary trigger signal generator and dwell angle-to-voltage converter depicted in FIG. 2.

The primary trigger signal generator 4, illustrated in FIG. 2 comprises: four resistors designated R1, R2, R3, and R4; three diodes designated D1, D2, and D3; a capacitor designated C1; an operational amplifier designated OA-1; two type-D flip-flops designated FF1 and FF2; and, a delay circuit 6.

$V_S$ is applied to ground through a voltage divider circuit formed by R1 and R2 connected in series. The junction between R1 and R2 is connected to the cathode of D2 and to the anode of D1. The anode of D2 is connected to ground and the cathode of D1 is connected to a positive voltage source designed V+. Thus, D1 and D2 form a clipping circuit that limits the complex waveform, $V_S$, to a value between zero and V+ volts. The values of R1 and R2 are chosen such that the value of R2 is much larger than the value of R1, resulting in practically the entire magnitude of the clipped waveform, $V_{C1}$ (FIG. 3, line B), being impressed across R2.

The junction between R1, R2, D1 and D2 is also connected to the noninverting input of OA-1 and through R3 to the anode of D3. The cathode of D3 is connected through C1 to ground, through R4 to ground and to the inverting input of OA-1. Thus, $V_{C1}$ is impressed across C1, through R3 and D3. As a result, a reference voltage is developed across C1. Because the system voltage of the internal combustion engine including the primary winding that produces $V_S$ is applied to the primary winding, the reference voltage is proportional to the system voltage of the internal combustion engine. This proportional relationship eliminates a need for an additional, separate reference voltage lead.

Figure 3:
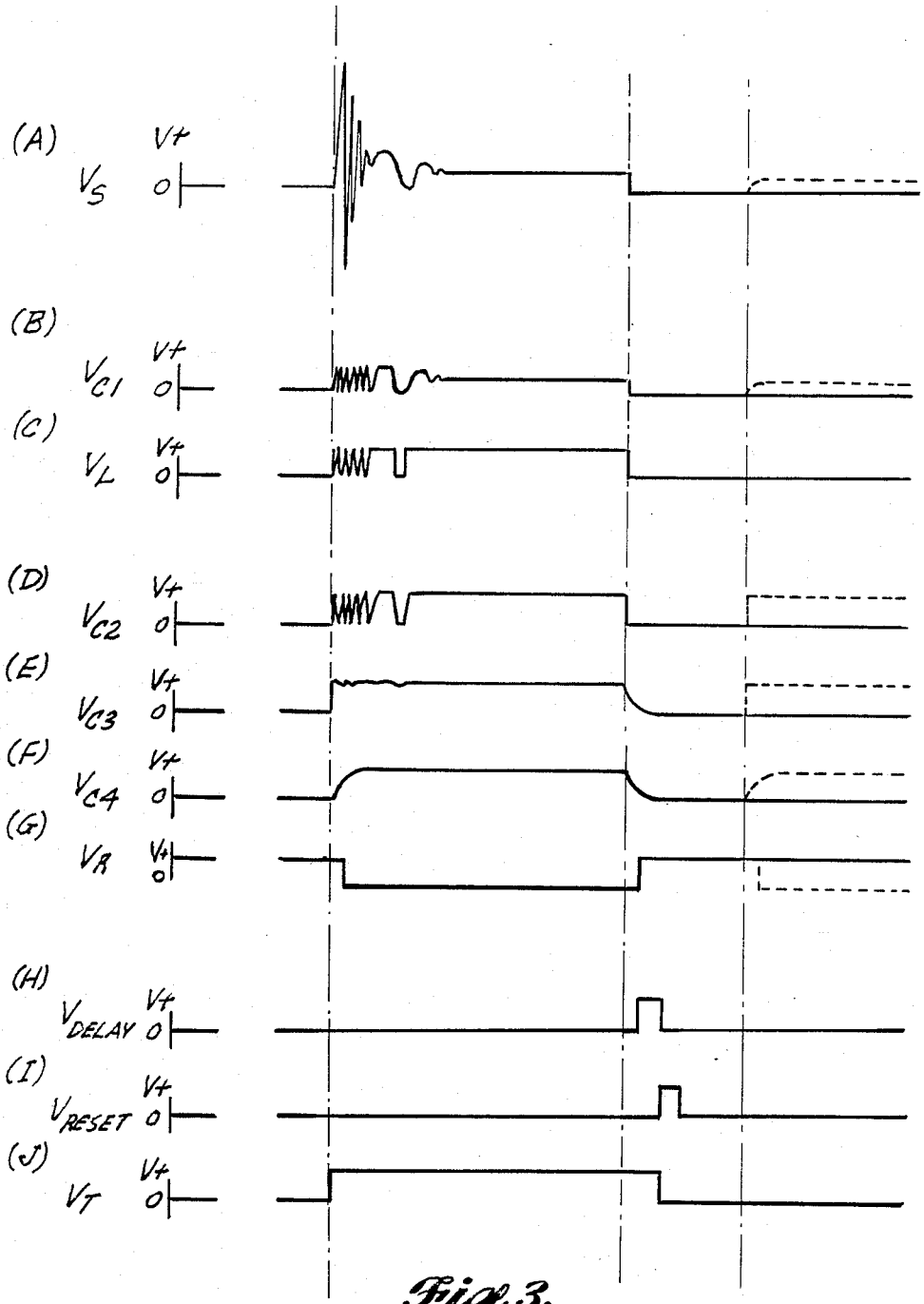

OA-1 compares the clipped waveform, $V_{C1}$, with the reference voltage and produces a logical signal, $V_L$ (see FIG. 3, line C). The first low-to-high level transition of the logical signal, $V_L$, corresponds to the point in time that the ignition points break, or the equivalent in an electronic or transistorized ignition system. The logical output of OA-1, $V_L$, is applied to the clock (CK) input of FF1. The D input of FF1 is connected to a logical one (1) voltage source. Thus, FF1 forms a bistable multivibrator whose Q and $\overline{Q}$ outputs shift from a reset state to a set state when the first low-to-high transition of $V_L$ occurs. Since $V_T$ is formed by the Q output of FF1, as shown in line J of FIG. 3, $V_T$ shifts from a low state to a high state upon FF1's receipt of the first rising edge of the logical output of OA-1, $V_L$, and remains high until FF1 is reset.

FF1 is reset by FF2 via the delay circuit 6. More specifically, the D input of FF2 is connected to a logical one (1) voltage source. FF2 is clocked by a logical output of the dwell angle-to-voltage converter 8 produced in the manner hereinafter described. The Q output of FF2 is connected to the clear (CL) input of FF1 via the delay circuit 6.

In summary, the primary trigger signal generator produces a signal squarewave per ignition point or solid state switch open and close cycle. Because the leading edge of the squarewave occurs with a minimal delay after the point in time the ignition points break or a solid state switch opens, $V_T$ is ideally suited to trigger the display of cathode ray tube based instruments designed to analyze internal combustion engine ignition signals.

A characteristic of many electronic or transistorized ignition systems currently in use is a relaxation of the conductivity of the electronic or transistorized ignition system control unit after the ignition coil has been sufficiently energized to limit the maximum ignition coil primary winding current during the points closed equivalent period of operation. This is represented on the primary ignition coil waveform, $V_S$, as the appearance of a voltage having a magnitude that is less than the steady state ignition points open equivalent signal magnitude prior to the point in time that the ignition point break equivalent occurs in the electronic or transistorized ignition system. The relaxation voltage is shown by a dashed line on the right end of the $V_S$ waveform (line A of FIG. 3). To guarantee a reliable trigger waveform, the relaxation voltage must not be interpreted as the ignition points break equivalent signal. This is accomplished by having the voltage reference generated on C1 approximate a proportion of the steady state ignition points open equivalent voltage (i.e., the internal combustion engine system voltage), and by the fact that the fixed proportion of the voltage that is from the relaxation voltage (shown in dashed line form on the right end of the $V_{C1}$ waveform, line B of FIG. 3) approaches but does not reach the reference.

The dwell angle-to-voltage converter illustrated in FIG. 2 comprises: five resistors designated R5, R6, R7, R8 and R9; five diodes designated D4, D5, D6, D7 and D8; three capacitors designed C2, C3 and C4; an operational amplifier designated OA-2; a buffer designated B1; and, an averaging network 9. $V_S$ is applied through R5 to the anode of D4 and the cathode of D5. The cathode of D4 is connected to V+ and the anode of D5 is connected to ground. Thus D4 and D5 form a clipping circuit that limits the range of the $V_S$ waveform to between zero and V+ volts. The junction between D4, D5 and R5 is connected to the anode of D6. The cathode of D6 is connected to ground through R6 in parallel with C2. Thus, the clipped waveform, $V_{C2}$ (FIG. 3, line D), produced at the junction between D4, D5 and R5 is impressed across C2, which charges to a maximum value of +V volts. The rate of discharge of C2 is determined by the time constant of R6 and C2. In accordance with this invention, the value of R6 is chosen to be much greater than the value of R5, resulting in C2 charging quickly relative to its rate of discharge. The rapid charging of C2 corresponds to the time of the ignition points break, or the equivalent in an electronic or transistorized ignition system. Because the voltage across C2 discharges at a relatively slow rate, it is relatively unaffected by the fluctuations in the clipped waveform, $V_{C2}$, resulting in the voltage across C2, designated $V_{C3}$ (FIG. 3, line E), having a stable waveform.

The junction between D6, R6 and C2 is connected to the cathode of D7. The anode of D7 is connected through C3 to ground, through R7 to V+ and to the inverting input of OA-2. The noninverting input of OA-2 is connected through R8 to V+, through C4 to ground and to the anode of D8. The cathode of D8 is connected through R9 to ground. At the point in time that the ignition points close in a breaker plate ignition system, or a solid state switch closes in an electronic or transistorized ignition system, the V+ charge on C2 discharges to approximately zero volts at the discharge rate determined by the time constant of R6 and C2. As C2 discharges, C3 discharges through reverse connected diode D7 at a rate determined by the time constant of R6 and C2. In accordance with this invention, the values of R7 and C3 are chosen so that the charge time constant of C3 equals the discharge time constant of C2. When the ignition points open (or the equivalent action occurs in an electronic ignition system), C3 will then charge at a rate determined by R7 and C3. This choice produces a signal wavform across C3, designated $V_{C4}$ (FIG. 3, line F), that is free from the ringing effect of the signal waveform across C2, previously designated $V_{C3}$. Further, $V_{C4}$ has a duty cycle that matches the duty cycle of the ignition points, or the equivalent in an electronic ignition system.

A reference voltage is created through a voltage divider created by resistors R8 and R9 and diode D8. D8 is included to provide a correction factor that negates the voltage drop across diode D7. The reference voltage and the voltage impressed across C3 are compared by OA-2. The comparison results in OA-2 producing a logical rectangular waveform, designated $V_R$ (FIG. 3, line G), having a period corresponding to the duty cycle of the ignition coil primary signal, $V_S$. The logical rectangular waveform, $V_R$, is inverted by OA-2 so that the period of $V_R$ matches the dwell angle of the ignition points in a breaker plate ignition system, or the equivalent in an electronic or transistorized ignition system.

$V_R$ forms a signal that resets FF1 and terminates $V_T$. More specifically, $V_R$ is applied to the clock (CK) input of FF2, resulting in the Q output of FF2 changing states. After a delay, the changed state resets FF1. Resetting of FF1 resets FF2 by virtue of the $\overline{Q}$ output of FF1 being connected to the clear (CL) input of FF2.

$V_R$ is conditioned by buffer B1, such that the low state of $V_R$ approximates zero volts and corresponds to zero degrees dwell and the high state of the $V_R$ approximates some fixed voltage that corresponds to a dwell angle equivalent of a 100% duty cycle. In other words, the buffer circuit B1 converts the output of O-A2 from the time domain to the voltage domain. An averaging network 9, comprising one or more RC filter stages further conditions the buffered waveform by averaging dwell voltages for all cylinders resulting in a voltage $V_{DA}$ that is proportional to the ignition points dwell angle of the internal combustion engine whose primary winding is generating $V_S$.

With an electronic or transistorized ignition system that creates a relaxation current on the ignition coil primary winding of the type shown in dashed form on the right side of line A of FIG. 3 and described above, a slight variation and generation of the rectangular waveform, $V_R$, takes place. The point in time that the relaxation current commences is perceived as the end of the ignition points closed equivalent period as shown in dashed form on the right end of lines E, F and G of FIG. 3 since the ignition coil becoming sufficently energized is the reason for the relaxation current. Therefore, the rectangular waveform, $V_R$, will only show that portion of the ignition point closed equivalence when no relaxation is in effect, which is the appropriate represntation of dwell angle (or duty cycle) of an electronic or transistorized ignition system.

While a preferred embodiment of the invention has been illustrated and described herein, it will be understood by one skilled in this art that various changes can be made in the apparatus without departing from the spirit and scope of the invention. For example, a nearly incalculable number of component combinations may produce different time constants associated with specific components or use of a combination of digital counters may be used in lieu of the bistable multivibrators. It is to be understood that these variations and others fall within the spirit and scope of the invention as defined in the appended claims.

The embodiments of the invention in which an exclusive property or privilege is claimed are defined as follows:

1. An ignition coil primary signal processing system suitable for use with diagnostic equipment related to spark ignition combustion engine such as cathode ray tube based internal combustion engine analyzer, said ignition coil primary signal processing system comprising:

(a) a primary trigger signal generator comprising:

(i) a clipping circuit for receiving the complex fluctuating ignition coil primary winding signals produced by an internal combustion engine each time the spark plug of one of the cylinders of said engine is fired and producing a clipped version of said ignition coil primary signals;

(ii) reference voltage means connected to said clipping circuit for receiving said clipped version of said ignition coil primary winding signals and producing a reference voltage that is proportional to the system voltage of the internal combustion engine associated with the ignition coil producing said ignition coil primary winding signals;

(iii) comparing means connected to said clipping circuit and said reference voltage means for receiving and comparing said reference voltage and said clipped version of said ignition coil primary winding signals and producing a related logical signal; and, (iv) a bistable circuit connected to said comparator for receiving said related logical signal and producing a rectangular waveform signal having a single leading edge corresponding to each complex fluctuation of said ignition coil primary winding signals, said leading edge substantially coinciding with the beginning of the corresponding complex fluctuation of said ignition coil primary winding signals; and, (b) a dwell angle-to-voltage converter comprising:

(i) a clipping circuit for receiving the complex fluctuating ignition coil primary winding signals produced by an internal combustion engine each time the spark plug of one of the cylinders of said engine is fired and producing a clipped version of said ignition coil primary winding signals;

(ii) signal conditioning means, including a plurality of RC circuits, connected to said clipping circuit for receiving said clipped version of said ignition coil primary winding signals and producing a stable waveform signal related to said clipped version of said ignition coil primary winding signals:

(iii) comparing means, including a voltage reference circuit for producing a reference voltage, for comparing said stable waveform signal produced by said signal conditioning means and said reference voltage produced by said voltage reference circuit and producing a logical rectangular waveform signal related to said stable waveform signal; and, (iv) indicating means connected to said comparing means for receiving said logical rectangular waveform signal produced by said comparing means and producing a proportional signal related to said logical rectangular waveform signal.

2. The ignition coil primary signal processing system claimed in claim 1, wherein said primary trigger signal generator clipping circuit is a series connected diode pair, said diode pair having the cathode of a first diode connected to a positive voltage source and the anode of a second diode connected to ground.

3. The ignition coil primary signal processing system claimed in claim 2, wherein said primary trigger signal generator clipping circuit also includes a voltage divider circuit comprising two resistors each having one end connected to the series junction of said first diode and said second diode of said diode pair and having the other end of one resistor connected to receive said ignition coil primary winding signal and the other end of the other resistor connected to ground.

4. The ignition coil primary signal processing system as claimed in claim 1, wherein said reference voltage means includes a storage capacitor and a forward biased diode for connecting said storage capacitor to the junction between said series connected diode pair.

5. An ignition coil primary signal processing system claimed in claim 1, wherein said bistable circuit includes a D flip-flop.

6. The ignition coil primary signal processing system claimed in claim 5, wherein said D flip-flop has its D-input connected to a logical one (1) voltage source and its clock input connected to receive said logical signal produced by said comparing means.

7. The ignition coil primary signal processing system claimed in claim 1, wherein said signal conditioning means comprises a first charging circuit for receiving said clipped version of said ignition coil primary winding signal and a second charging circuit for receiving a signal from said first charging circuit and producing said stable waveform signal related to said clipped version of said ignition coil primary winding signal.

8. The ignition coil primary signal processing system claimed in claim 7, wherein said second charging circuit and said voltage reference circuit of said comparing means of said dwell angle-to-voltage converter include a forward biased diode connected such that said forward biased diode of said dwell angle-to-voltage converter negates the effect of said forward biased diode of said second charging circuit.

9. The ignition coil primary signal processing system claimed in claim 8, wherein the voltage reference circuit of said comparing means of said dwell angle-to-voltage converter comprises a series circuit formed by said diode and first and second resistors connected between a voltage supply and ground.

10. The ignition coil primary signal processing system claimed in claim 9, wherein said indicating means comprises a signal buffer and an averaging circuit connected to said comparing means for receiving said logical rectangular waveform signal produced by said comparing means and converting said logical rectangular waveform signal from the time domain to the voltage domain.

11. A trigger generator comprising:

(a) a clipping circuit for receiving a complex signal, such as the complex fluctuating ignition coil primary winding signal produced by an internal combustion engine each time the spark plug at one of the cylinders of said engine is fired, and producing a clipped version of said complex signal;

(b) reference voltage means connected to said clipping circuit for receiving said clipped version of said complex signal and producing a reference voltage that is proportional to the system voltage of the system producing said complex signal;

(c) comparing means connected to said clipping circuit and said reference voltage means for comparing said reference voltage and said clipped version of said complex signal and producing a related logical signal; and (d) a bistable circuit connected to said comparator for receiving said related logical signal and producing a rectangular waveform signal having a single leading edge substantially coinciding with the beginning of said first fluctuation of said complex signal.

12. The trigger signal generator claimed in claim 11, wherein said clipping circuit is a series connected diode pair, and diode pair having the cathode of a first diode connected to a positive voltage source and the anode of a second diode connected to ground.

13. The primary trigger signal generator claimed in claim 12, wherein said clipping circuit includes a voltage divider circuit comprising two resistors each having one end connected to the series junction of said first diode and said second diode of said diode pair and having the other end of one resistor connected to receive said ignition coil primary winding signal and the other end of the other resistor connected to ground.

14. The trigger signal generator claimed in claim 11, wherein said reference voltage means includes a storage capacitor and a forward biased diode for connecting said storage capacitor to the junction between said series connected diode pair.

15. A trigger signal generator claimed in claim 11, wherein said bistable circuit includes a D flip-flop.

16. The trigger signal generator claimed in claim 15, wherein said flip-flop has its D-input connected to a logical one (1) voltage source and its clock input connected to receive said logical signal produced by said comparing means.

17. The trigger signal generator claimed in claim 16, wherein said bistable circuit also includes a second D flip-flop and a delay circuit, said second D flip-flop having its D-input connected to a logical one (1) voltage source and its output connected to the clear input of said first D flip-flop through said delay circuit, said second D flip-flop is connected to be reset by the output of said first D flip-flop.

18. A dwell angle-to-voltage converter comprising:

(a) a clipping circuit for receiving the complex fluctuating ignition coil primary winding signals produced by an internal combustion engine each time the spark plug of one of the cylinders of said engine is fired and producing a clipped version of said ignition coil primary winding signal;

(b) signal conditioning means, including a plurality of RC circuits, connected to said clipping circuit for receiving said clipped version of said ignition coil primary winding signal producing a stable waveform signal related to said clipped version of said ignition coil primary winding signal, said signal conditioning means also including a first charging circuit for receiving said clipped version of said ignition coil primary winding signal and a second charging circuit for receiving a signal from said first charging circuit and producing said stable waveform signal related to said clipped version of said ignition coil primary winding signal;

(c) comparing means, including a voltage reference circuit for producing a reference voltage, for comparing said stable waveform signal produced by said signal conditioning means and said reference voltage produced by said voltage reference circuit and producing a logical rectangular waveform signal corresponding to said stable waveform signal, said second charging circuit and said voltage reference circuit each containing a forward biased diode connected such that said forward biased diode of said voltage reference circuit negates the effect of said forward biased diode of said second charging circuit; and (d) indicating means connected to said comparing means for receiving said logical rectangular waveform signal produced by said comparing means and producing a signal proportional to said logical rectangular waveform signal.

19. The dwell angle-to-voltage converter claimed in claim 18, wherein said clipping circuit comprises a series connected diode pair and a resistor, the cathode of one of said diodes connected to a positive voltage supply and the anode of the other said diodes connected to ground, the anode of said one diode connected to the cathods of said other diode, one end of said resistor connected to the junction between said first and second diodes and the other end of said resistor connected to receive said ignition coil primary winding signal.

20. The dwell angle-to-voltage converter claimed in claim 18, wherein said voltage reference circuit includes a series circuit formed by said diode and first and second resistors between a voltage supply and ground.

21. The dwell angle-to-voltage converter claimed in claim 20, wherein said indicating means comprises a signal buffer and an averaging circuit connected to said comparing means for receiving said logical rectangular waveform signal produced by said comparing means and converting said logical rectangular waveform signal from the time domain to the voltage domain.

* * * * *

UNITED STATES PATENT AND TRADEMARK OFFICE

CERTIFICATE OF CORRECTION

PATENT NO. : 4,847,562

DATED : July 11, 1989

INVENTOR(S) : Bill E. Bailey

It is certified that error appears in the above-identified patent and that said Letters Patent is hereby corrected as shown below:

Column 8, line 49: after "trigger" insert --signal--
Column 9, line 5: "and" should be --said--
Column 10, line 32: "cathods" should be --cathode--

Signed and Sealed this

Twenty-first Day of August, 1990

*Attest:*

HARRY F. MANBECK, JR.

*Attesting Officer*

*Commissioner of Patents and Trademarks*